US011045018B2

(12) United States Patent
Berents et al.

(10) Patent No.: US 11,045,018 B2
(45) Date of Patent: Jun. 29, 2021

(54) DISPLAY UNIT FOR STORING AND DISPLAYING HEATED GOODS, AND USE OF A DISPLAY UNIT

(71) Applicant: Fri-Jado B.V., Oud Gastel (NL)

(72) Inventors: Robert Evert Willem Berents, Berkel-Enschot (NL); Johannes Gerrad Kappers, Vlaardingen (NL)

(73) Assignee: Fri-Jado B.V., Oud Gastel (NL)

( * ) Notice: Subject to any disclaimer, the term of this patent is extended or adjusted under 35 U.S.C. 154(b) by 428 days.

(21) Appl. No.: 16/305,580

(22) PCT Filed: Jun. 25, 2017

(86) PCT No.: PCT/NL2017/050423

§ 371 (c)(1),
(2) Date: Nov. 29, 2018

(87) PCT Pub. No.: WO2018/004337

PCT Pub. Date: Jan. 4, 2018

(65) Prior Publication Data

US 2019/0328154 A1 Oct. 31, 2019

(30) Foreign Application Priority Data

Jun. 27, 2016 (NL) ..... 2017055

(51) Int. Cl.
*A47F 3/00* (2006.01)
*A47F 7/00* (2006.01)

(52) U.S. Cl.
CPC ..... *A47F 3/001* (2013.01); *A47F 3/005* (2013.01); *A47F 7/0071* (2013.01)

(58) Field of Classification Search
CPC .. A47F 3/00; A47F 3/001; A47F 3/005; A47F 3/007; A47F 3/04; A47F 3/0408; A47F 3/0413; A47F 3/0421; A47F 3/0434; A47F 3/0439; A47F 3/0443;
(Continued)

(56) References Cited

U.S. PATENT DOCUMENTS 2,836,039 A * 5/1958 Weber ..... A47F 3/0447 62/252
3,009,333 A * 11/1961 Rainwater ..... A47F 3/0443 62/256

(Continued)

FOREIGN PATENT DOCUMENTS

WO 2010/002243 A2 1/2010

*Primary Examiner* — Patrick D Hawn
(74) *Attorney, Agent, or Firm* — Rogowski Law LLC

(57) ABSTRACT

A display unit 1 for storing and displaying heated goods comprises walls 2, 4, 6, 8, shelves 10, 12, 14, 16, an air duct 18, a fan 20, 22, and an air heater 24. The walls delimit a main chamber 26 including a first open front side 28 and a second open front side 30 opposite of the first open front side. The shelves each comprise an upper placing side 32, and define an individual storage spaces 34, 36, 38, 40. The air duct 18 extends from an inlet 42, 44 to multiple outlets 46 which are in communication with the storage spaces. The display unit further comprises a transparent wall 48, 50, which is positioned in the main chamber 26 between the first open front side and the second open front side, and divides the main chamber in a first chamber 52 and a second chamber 54.

20 Claims, 6 Drawing Sheets

(58) Field of Classification Search
CPC ..... A47F 3/0447; A47F 3/0456; A47F 2003/046; A47F 7/0071; A47F 10/06
See application file for complete search history.

(56) References Cited

U.S. PATENT DOCUMENTS 3,204,421 A * 9/1965 Jirel ..... A47F 3/0408 62/186
3,717,395 A * 2/1973 Spielvogel ..... A47F 3/005 312/114
4,074,108 A * 2/1978 King ..... A47J 36/2483 219/214
4,343,985 A * 8/1982 Wilson ..... A47J 36/2488 219/214
4,373,355 A * 2/1983 Monroe ..... A47F 3/0447 62/256
4,777,806 A * 10/1988 Perez ..... A47F 3/0447 62/256
5,477,702 A * 12/1995 Kennedy ..... A47F 3/0447 62/256
5,499,513 A * 3/1996 Bustos ..... A47F 3/0408 62/252
5,931,013 A * 8/1999 Wickman ..... F25D 17/06 62/255
6,367,274 B1 * 4/2002 Mellado ..... A47F 3/0447 62/255
6,627,855 B2 * 9/2003 Hohler ..... A47F 3/001 219/214
7,137,438 B2 * 11/2006 Nomura ..... A47F 3/0443 165/64
7,285,752 B2 * 10/2007 Barker ..... A21B 1/00 219/214
7,829,823 B2 * 11/2010 Nuttall ..... A47F 10/06 219/214
8,729,429 B2 * 5/2014 Nuttall ..... A47F 3/001 219/214
9,526,354 B2 * 12/2016 Barreto ..... A47F 3/0443
9,565,954 B2 * 2/2017 Nuttall ..... A47F 3/001
9,675,185 B2 * 6/2017 Anderson ..... A47F 3/0447
9,788,666 B2 * 10/2017 Wood ..... A47F 3/0447
2002/0005686 A1 * 1/2002 Nuttall ..... A47F 3/001 312/236
2004/0177634 A1 * 9/2004 Yamazaki ..... A47F 3/0443 62/248
2007/0138167 A1 * 6/2007 Friedman ..... A47F 3/001 219/544
2008/0035631 A1 * 2/2008 Barker ..... A47F 3/001 219/386
2010/0140057 A1 * 6/2010 Ishino ..... A47F 10/06 198/867.11
2010/0313588 A1 * 12/2010 Swofford ..... A47F 3/0443 62/251
2011/0147362 A1 * 6/2011 Van Dorst ..... A47F 3/001 219/218
2017/0188720 A1 * 7/2017 Palmnas ..... A47F 3/04
2019/0328154 A1 * 10/2019 Berents ..... A47F 3/0443

* cited by examiner

DISPLAY UNIT FOR STORING AND DISPLAYING HEATED GOODS, AND USE OF A DISPLAY UNIT

CROSS-REFERENCE TO RELATED APPLICATIONS

This application is a national stage application (under 35 USC § 371) of PCT/NL2017/050423, filed Jun. 25, 2017, which claims benefit of Netherlands application No. 2017055, filed Jun. 27, 2016, the contents of each of which are incorporated by reference herein.

BACKGROUND OF THE INVENTION

The invention relates to a display unit used to present heated goods in shops, snack bars, gas pump stations, fast food restaurants, cafeterias, and the like. An air forcing apparatus, such as a fan, and an air heater, such as a heating element, are provided in order to keep the goods hot.

A display unit of this type is known from WO-2010/002243-A2. The display unit of WO-2010/002243-A2 comprises walls, multiple shelves, an air duct, a fan and an air heater. The walls delimit one chamber with an open front side. The multiple shelves each comprise an upper placing side, and are provided above each other to define an individual storage space above each shelf. The air duct extends from an inlet opening to multiple outlets whereby the outlets each define a flow direction. The flow directions of the multiple outlets point away from the corresponding placing sides.

A disadvantage of the known display unit is that its use is limited in terms of placement options. In particular, the known display unit is best placed against a wall, while other positions in a room are less desirable.

The invention aims to solve to this problem, or at least to provide an alternative. In particular, the invention aims to provide a display unit that allows users to reach for the goods from at least two sides of the display unit, while ensuring an effective and efficient temperature control of the stored goods.

SUMMARY OF THE INVENTION

A display unit for storing and displaying heated goods comprises multiple walls, multiple shelves, an air duct, an air forcing apparatus, and an air heater. At least part of the walls of the display unit delimit a main chamber including a first open front side and a second open front side opposite of the first open front side. The multiple shelves each comprise an upper placing side. The multiple shelves each extend in the main chamber and define an individual corresponding storage space above their upper placing side. The air duct extends from at least a first inlet to multiple outlets which are in communication with the storage spaces. The display unit further comprises a transparent wall, which is positioned in the main chamber between the first open front side and the second open front side, and divides the main chamber in a first chamber and a second chamber.

Within the context of the invention, open front sides are openings connecting the main chamber with an environment in which the display unit is placed. Thanks to the two open front sides, users can see and reach for the goods that are in the main chamber of the display unit from two sides. This allows for placement of the display unit in an island position, and not just against a wall. Moreover, considering that the depth of a display unit is limited from a user point of view, having two open front sides enables a larger display unit and thus more storage capacity. The transparent wall ensures that the airflow within the first and second chamber is not adversely affected by the airflow in the other chamber, or by draught which might otherwise run through the main chamber from the first open front side to the second open front side, or reversely.

In an embodiment, the transparent wall is made of glass. Glass is heat resistant, has good transparency, and is readily cleaned.

In an embodiment, the transparent wall is positioned halfway the main chamber. This provides first and second chambers of equal size, which is practical from a use point of view.

In an embodiment, the air duct comprises a first vertically extending outlet duct for guiding air towards the outlets. In particular the first vertically extending outlet duct is positioned at a side edge of the transparent wall. This allows the transparent wall to be in the center, which enhances the impression of one uninterrupted chamber.

In particular, the air duct comprises a second vertically extending outlet duct for guiding air towards the outlets. In particular the second vertically extending outlet duct is positioned at a side edge of the transparent wall opposite of the first vertically extending outlet duct. By having two outlet ducts, the outgoing air flow is divided over two, and can be transported in a more equal manner towards the outlets. Moreover, each individual outlet duct can be smaller, thus less obstructing the main chamber. By having both ducts opposite of each other, a symmetry is achieved, and the impression of one uninterrupted chamber is enhanced even further.

In an embodiment, the air duct comprises a first vertically extending inlet duct for guiding air from the first inlet. In particular the first vertically extending inlet duct is positioned at a side edge of the transparent wall. This allows the transparent wall to be in the center, which enhances the impression of one uninterrupted chamber. In a particular embodiment, the first vertically extending outlet duct, and the first vertically extending inlet duct, are both at a side edge of the transparent wall, which allows for integration of both ducts and further improves the impression of one uninterrupted chamber.

In particular, the air duct comprises a second vertically extending inlet duct for guiding air from a second inlet. More in particular, the second vertically extending inlet duct is positioned at a side edge of the transparent wall opposite of the first vertically extending inlet duct. By having two inlets and inlet ducts, the outlet air flow is taken in from two points, resulting in a better airflow towards the inlets. Moreover, each individual duct can be smaller, thus less obstructing the main chamber. By having both ducts opposite of each other, a symmetry is achieved, and the impression of one uninterrupted chamber is enhanced even further.

In an embodiment, the first inlet, and optional second inlet are provided in the main chamber, in particular an upper region of the main chamber. By drawing air from the main chamber, air is at least partly recirculated and requires less conditioning compared to taking air from outside the display unit. Providing the inlets in the upper region is particularly advantageous in combination with the circulation of hot air, as it flows upwards naturally.

In an embodiment, at least part of the outlets, in particular all outlets, are positioned at a front edge of one of the shelves. In particular, at least part of the outlets, in particular all outlets, are positioned at a front edge of all shelves. In particular at least part of the outlets, or all outlets, are directed upwards and towards the transparent wall for directing an airflow into the corresponding storage space. Providing the outlets at a front edge of the shelf allows for creating an air curtain in front of the relevant storage space. Having the outlets directed upwards and towards the transparent wall, results in both an air curtain and a circulation of hot air in the storage space, for conditioning of the goods.

In an embodiment, all outlets discharge into the storage spaces. This results in a maximum heat transfer between the hot air, and the goods.

In an embodiment, at least one of the shelves is hollow and defines part of the air duct. This is not only efficient from a material point of use, but also allows for heat transfer between the air in the hollow shelf and the goods on top of the shelf.

In an embodiment, the upper placing side of at least one of the shelves is airtight. This prevents air from flowing directly from the air duct to the goods on the shelf, which may deteriorate their quality.

In an embodiment, the air heater comprises at least one heating element, in particular an electrical heating element.

In an embodiment, the at least one heating element is provided in one of the multiple shelves. This is both efficient in terms from a construction point of view, as the heating elements do not need to be placed elsewhere in the construction, where a heating element might require extra space as it is from an energy efficiency point of view because the heat is applied in the area where the goods need to be conditioned. Moreover, this position allows for an extra heat transfer in the form of radiation heat from the heating elements, via the shelf, to the goods.

In an embodiment, the air heater comprises multiple heating elements, and each of the multiple shelves is provided with one heating element, in particular a flat shaped heating element.

In an embodiment, the air heater comprises multiple heating elements, and all shelves are provided with multiple heating elements.

In an embodiment, at least one shelf comprises a pressure chamber. The pressure chamber is part of the air duct. The pressure chamber(s) comprises multiple openings, connecting the pressure chamber with a hollow space of the respective shelf. The pressure chamber provides for a uniform air flow through the hollow space of the respective shelf. In particular, the pressure chamber has an elongated rectangular shape. In particular, the pressure chamber is provided in the hollow space of the respective shelf. In particular, the pressure chamber extends along the width direction of each shelf. In particular, the pressure chamber is in communication with the first and optional second vertically extending outlet duct.

DESCRIPTION OF THE DRAWINGS

The invention, its effects, and advantages will be explained in more detail on the basis of a schematic drawing, in which.

DETAILED DESCRIPTION

Figure 1:
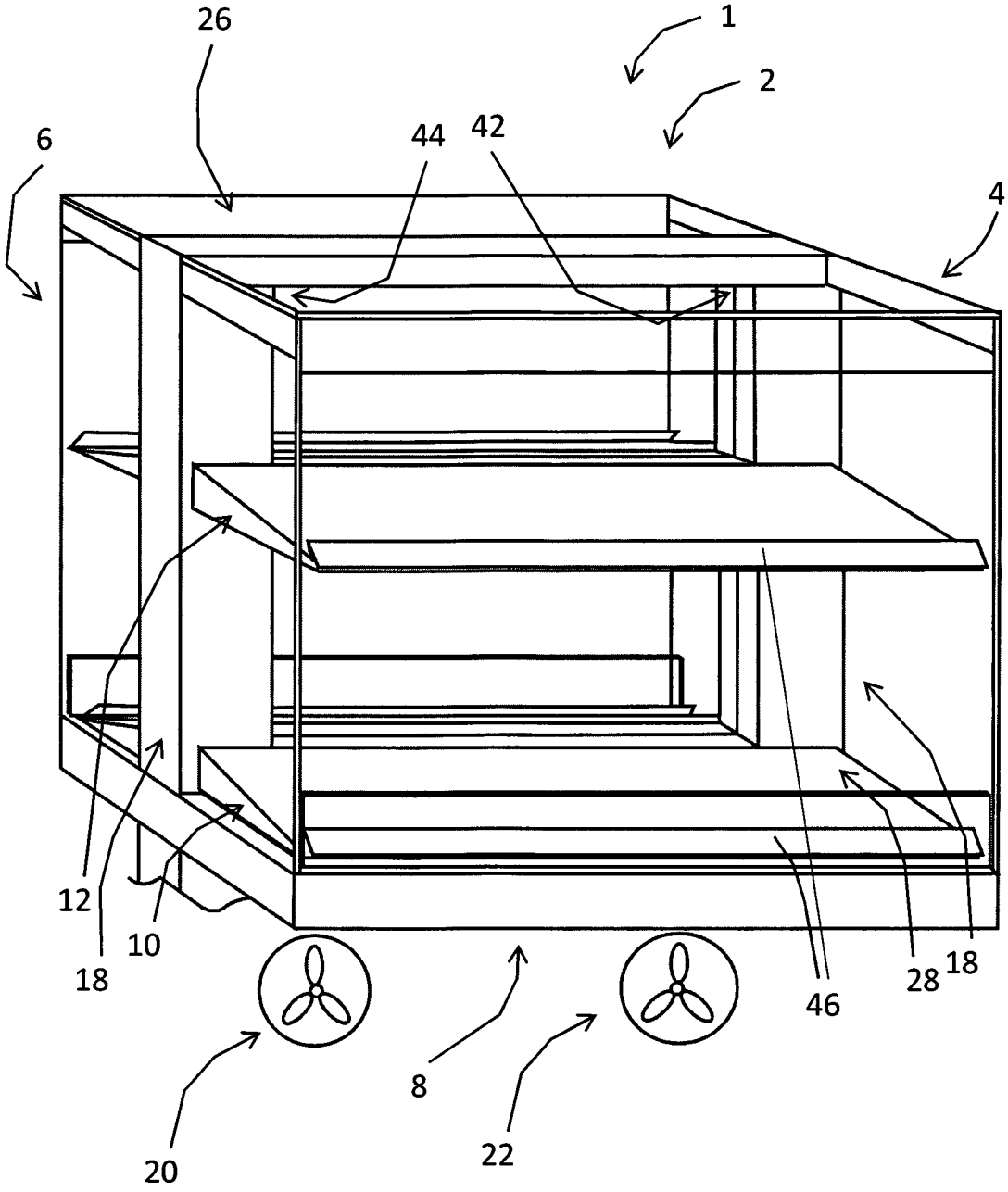
FIG. 1 shows a perspective view of a first embodiment of a display unit according to the invention.

FIGS. 1-7 show a first embodiment of a display unit for storing and displaying heated goods according to the invention, which is denoted in its entirety by reference number 1. The display unit 1 comprises a top wall 2, side walls 4, 6, and bottom wall 8. In this embodiment, the side walls 4, 6 are made of glass, while the top 2 and bottom wall 8 are made of metal. The display unit 1 further comprises a support structure, which is not shown in the figures as any conventional support structure can be used within the scope of the invention.

The display unit 1 of this embodiment further comprises four shelves 10, 12, 14, 16, two air ducts 18, and an air forcing apparatus, in this embodiment two fans 20, 22, as is shown schematically in FIG. 1. The two fans 20, 22 are positioned in the support structure. The two fans 20, 22 are provided within the air ducts 18, and the air ducts 18 in the support structure are closed, i.e. are not provided with other inlets or outlets than those described below.

Figure 2:
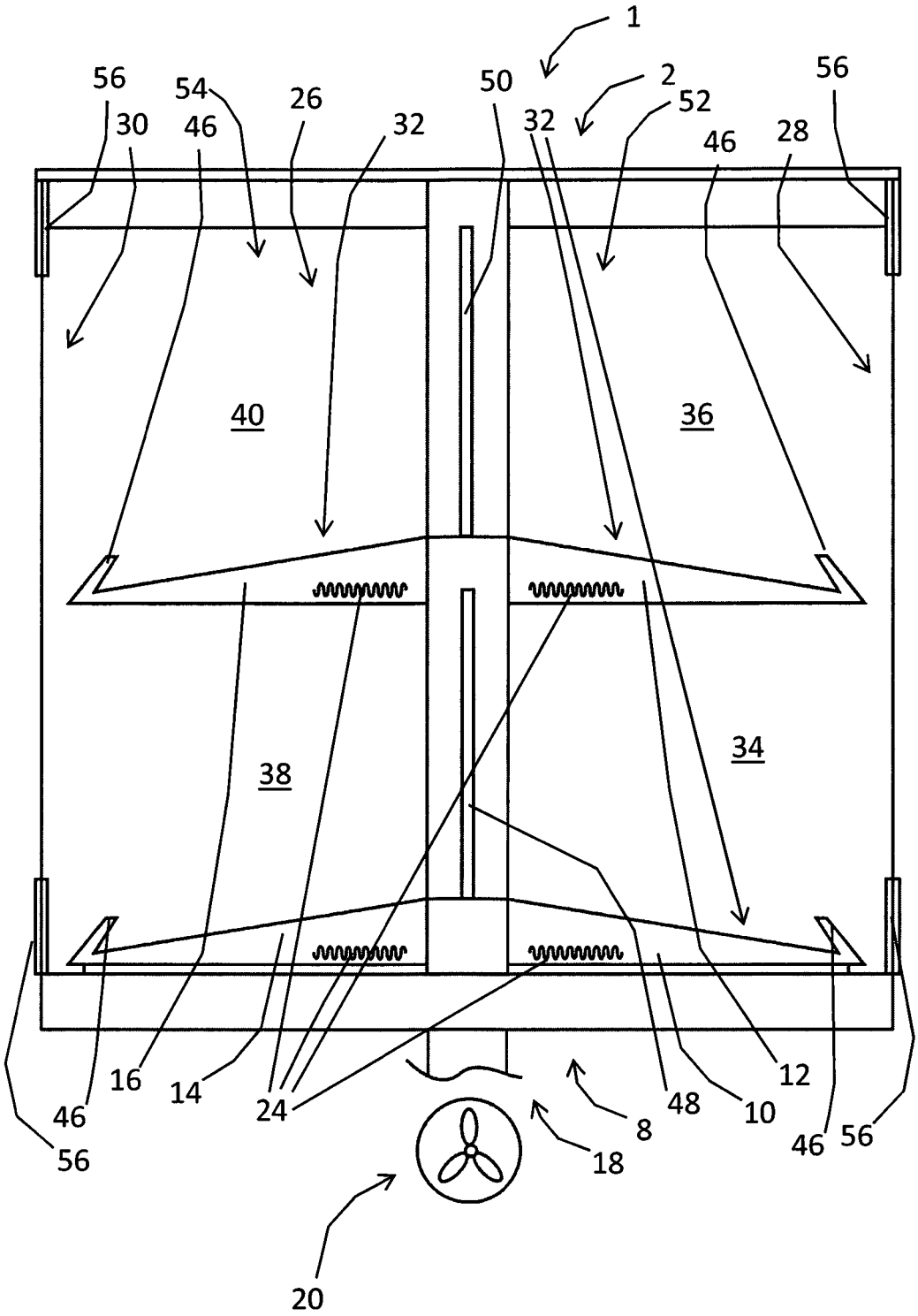
FIG. 2 shows a cross section view through the display unit of FIG. 1.

The display unit 1 further comprises an air heater. In this embodiment, the air heater comprises multiple electrical heating elements 24, and all shelves 10, 12, 14, 16 are provided with electrical heating elements 24, as shown in FIG. 2.

The top wall 2, side walls 4, 6, and bottom wall 8 delimit a main chamber 26. The main chamber 26 has a first open front side 28 and a second open front side 30 opposite of the first open front side 28. The multiple shelves 10, 12, 14, 16 each comprise an upper placing side 32 on which goods can be placed.

Each air duct 18 extends from a first inlet 42, or from a second inlet 44, to multiple outlets 46 which are in communication with the storage spaces 34, 36, 38, 40. The first and second inlets 42, 44 are provided in an upper region of the main chamber 26, as is shown in more detail in FIG. 7. Each outlet 46 is a slotted-shaped opening that extends as one opening over substantially the entire width of each shelf 10, 12, 14, 16.

The display unit 1 further comprises two vertically extending transparent walls 48, 50 made of glass, which are positioned above each other in the main chamber 26 halfway between the first open front side 28 and the second open front side 30. The transparent walls 48, 50 divide the main chamber 26 into a first chamber 52 and a second chamber 54. The multiple shelves 10, 12, 14, 16 each extend in the main chamber 26. In this embodiment, half of the multiple shelves, shelves 10 and 12, are provided above each other in the first chamber 52 to define individual corresponding storage spaces 34, 36 above their upper placing side 32. The other half of the multiple shelves, shelves 14 and 16, are provided above each other in the second chamber 54 to define individual corresponding storage spaces 38, 40 above their upper placing side 32. The lower transparent wall 48 extends vertically from the bottom wall 8 to the upper shelves 12, 16. The upper transparent wall 50 extends vertically from the upper shelves 12, 16 to the top wall 2.

The lower and upper borders of the first open front side 28 and the second open front side 30 are delimited by rectangular transparent sheets, in this embodiment rectangular glass sheets 56. The glass sheets 56 make the first open front side 28 and the second open front side 30 physically slightly smaller, without visually decreasing the size of the first open front side 28 and the second open front side 30. The lower glass sheets 56 are located adjacent the outlets 46 of the lower shelves 10, 14. They prevent, or at least decrease the amount of, cool air being drawn into the respective storage space 34, 38 by the relative high velocity of air exiting the outlets 46. The upper glass sheets 56 prevent, or at least decrease the amount of, cool air entering the upper side of the upper storage spaces 36, 40, and help the warmer air stay within the upper storage spaces 36, 40 (see also FIG. 5).

Figure 3:
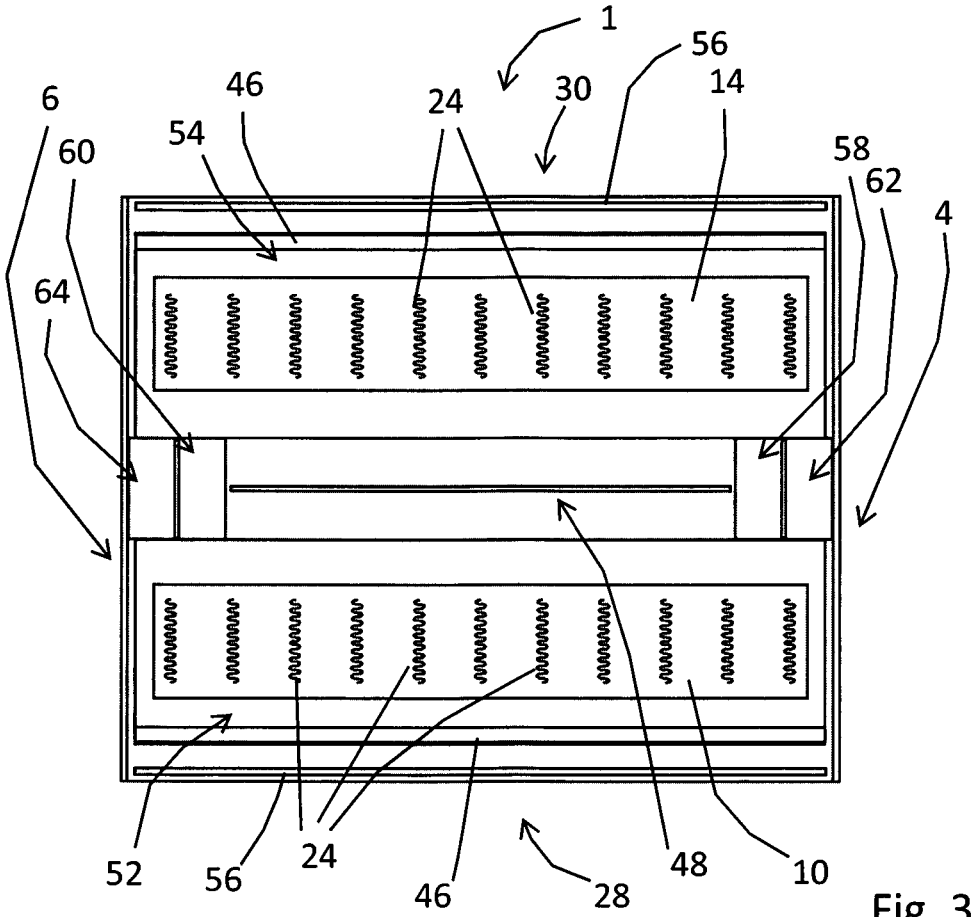
FIG. 3 shows a top section view through the display unit of FIG. 1.

Referring to FIG. 3, the air ducts 18 comprises a first vertically extending outlet duct 58 and a second vertically extending outlet duct 60 for guiding air from the fans 20, 22 towards the outlets 46. The first vertically extending outlet duct 58 and the second vertically extending outlet duct 60 are positioned at side edges of the transparent walls 48, 50, opposite of each other. The air ducts 18 further comprise a first vertically extending inlet duct 62 and a second vertically extending inlet duct 64 for guiding air from the first inlet 42, respectively from the second inlet 44, towards the fans 20, 22. The first and second vertically extending inlet ducts 62, 64 are positioned at side edges of the transparent wall 48, 50 opposite of each other. In this embodiment, the first vertically extending outlet duct 58 is integrated with the first vertically extending inlet duct 62. Likewise, the second vertically extending outlet duct 60 is integrated with the second vertically extending inlet duct 64. Seen from the outside, as shown in FIG. 1, the integrated outlet and inlet ducts appear as two vertically extending columns, which together with the top and bottom walls 2, 8 form a frame for the transparent walls 48, 50, and support the multiple shelves 10, 16. The integrated inlet and outlet ducts together with the transparent walls 48, 50 separate the first chamber 52 and the second chamber 54 in a substantially airtight manner. Substantially airtight means within the scope of the invention that there might be some clearance between the integrated inlet and outlet ducts together with the transparent walls 48, 50 for practical purposes, such as cleaning, and constructional purposes, such as allowance for thermal expansion. However, this clearance is so small that any air exchange between the first and second chambers 52, 54 is negligible compared to the main air flows as described below. In particular, any air exchange between the first and second chambers 52, 54 is less than 5%, in particular less than 1%, of the joint air flow through the ducts 18.

Figure 4:
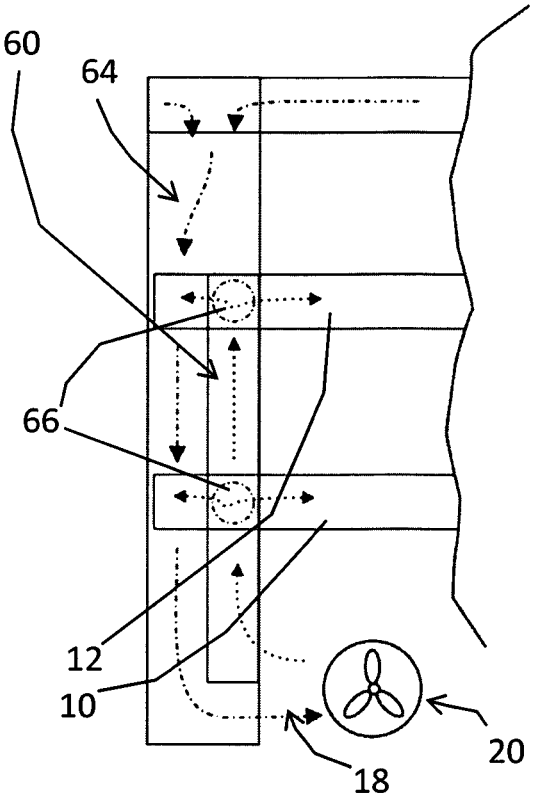
FIG. 4 shows a partial longitudinal section view through the display unit of FIG. 1.
Figure 5:
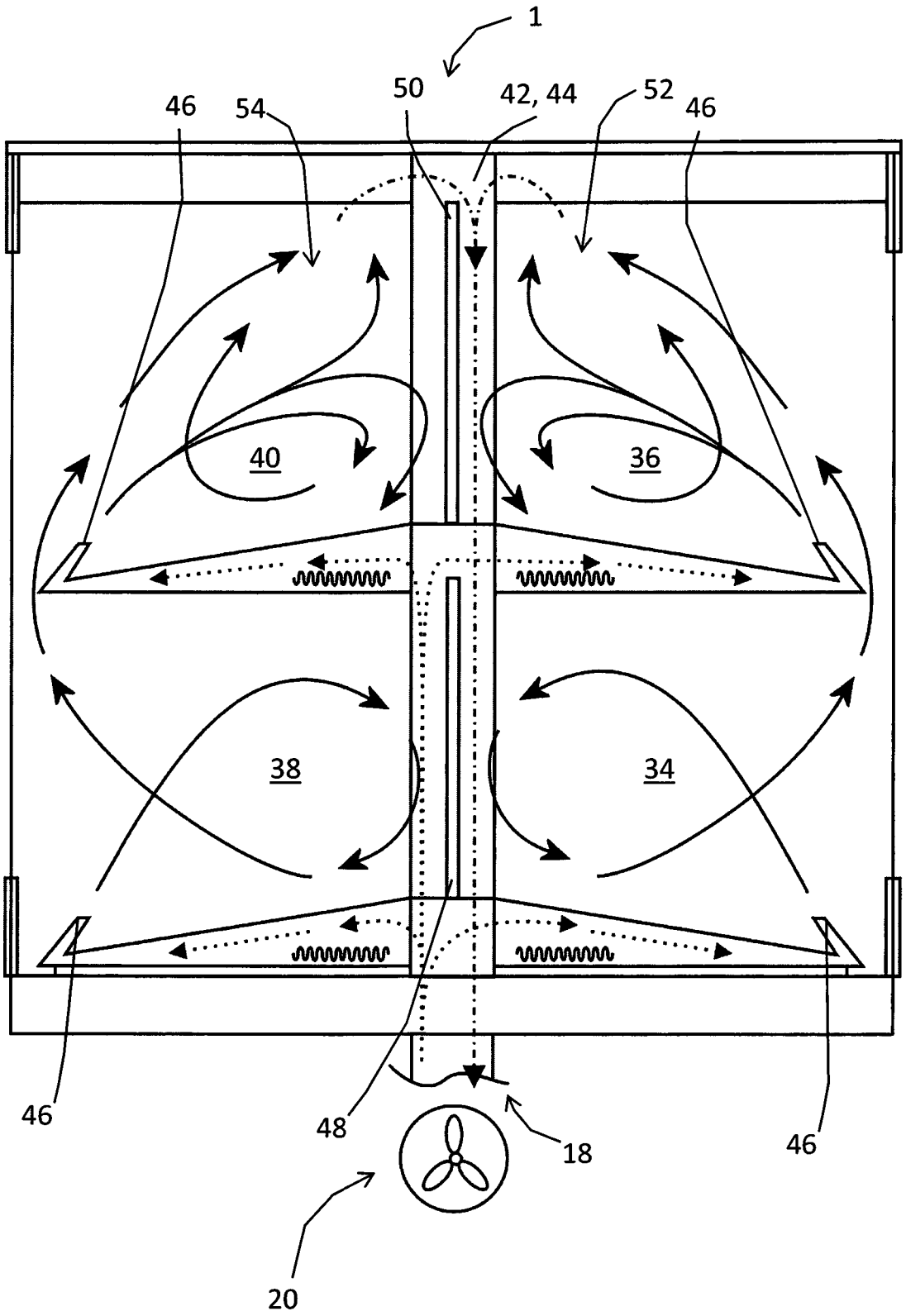
FIG. 5 shows the view of FIG. 2 of the display unit in use.
Figure 6:
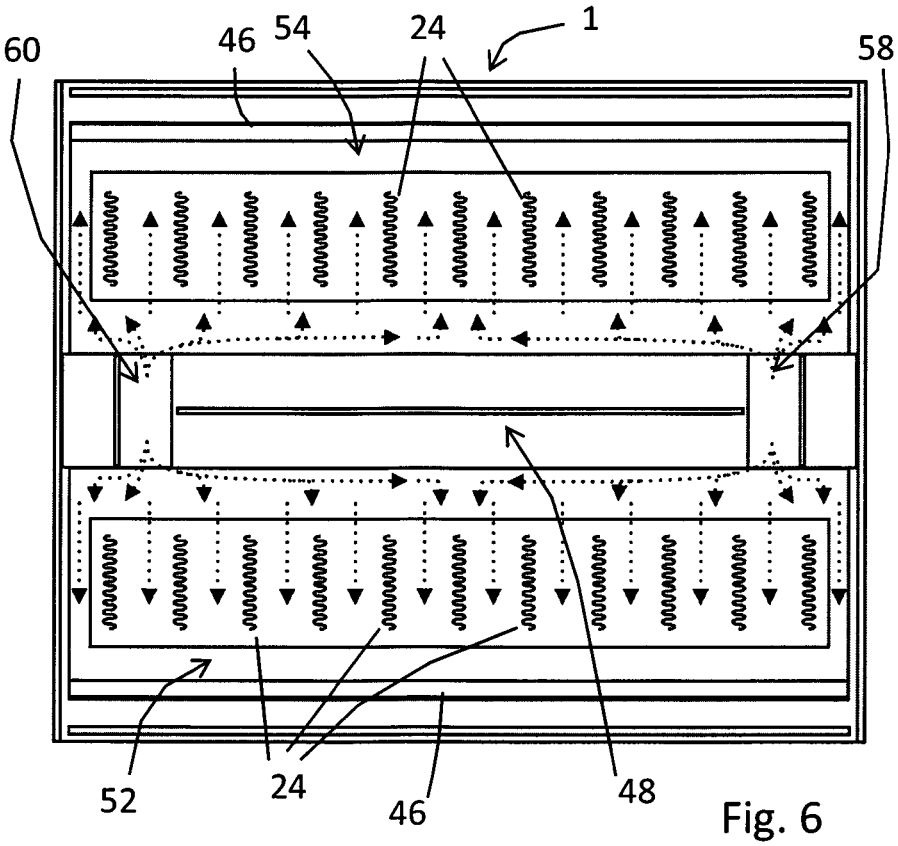
FIG. 6 shows a top section view through the display unit of FIG. 1 in use.
Figure 7:
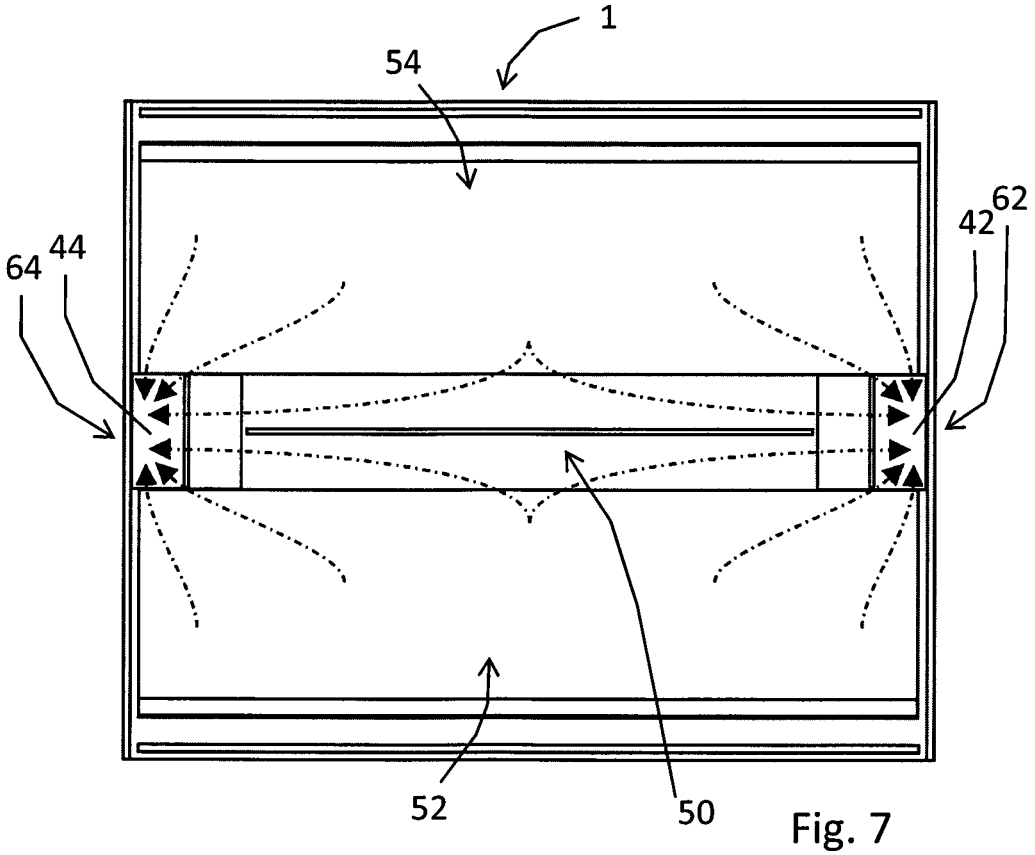
FIG. 7 shows another top section view through the display unit of FIG. 1 in use.

FIG. 4 shows that the multiple shelves 10, 12, 14, 16 are hollow, and that the first vertically extending outlet duct 60 and the shelves 10, 12 are provided with corresponding openings 66. In this embodiment, but not shown in the figures, there are similar openings connecting the second vertically extending outlet duct 62, with the shelves 10, 12, connecting the first vertically extending outlet duct 60 with the shelves 14, 16, and connecting the second vertically extending outlet duct 62, with the shelves 14, 16. The openings 66 allow air to flow from the respective outlet duct 60, 62 into the respective communicating hollow shelves 10, 12, 14, 16, and onwards to the outlet openings 46.

In this embodiment, all outlets 46 are positioned at a front edge of the multiple shelves 10, 12, 14, 16. Moreover, all outlets 46, are directed upwards, i.e. away from the placing sides 32, and towards the transparent wall 48, 50 for directing an airflow into the corresponding storage space 34, 36, 38, 40. The upper placing side 32 of all shelves 10, 12, 14, 16 of this embodiment are airtight. Moreover, the first and second vertically extending outlet ducts 58, 60, as well as the first and second vertically extending inlet ducts 62, 64, of this embodiment are airtight too, except for the inlets 42, 44, the outlets 46, and the openings 66. As a result, the air ducts 18 discharge air only via the outlets 46 into the storage spaces 34, 36, 38, 40.

Figure 8:
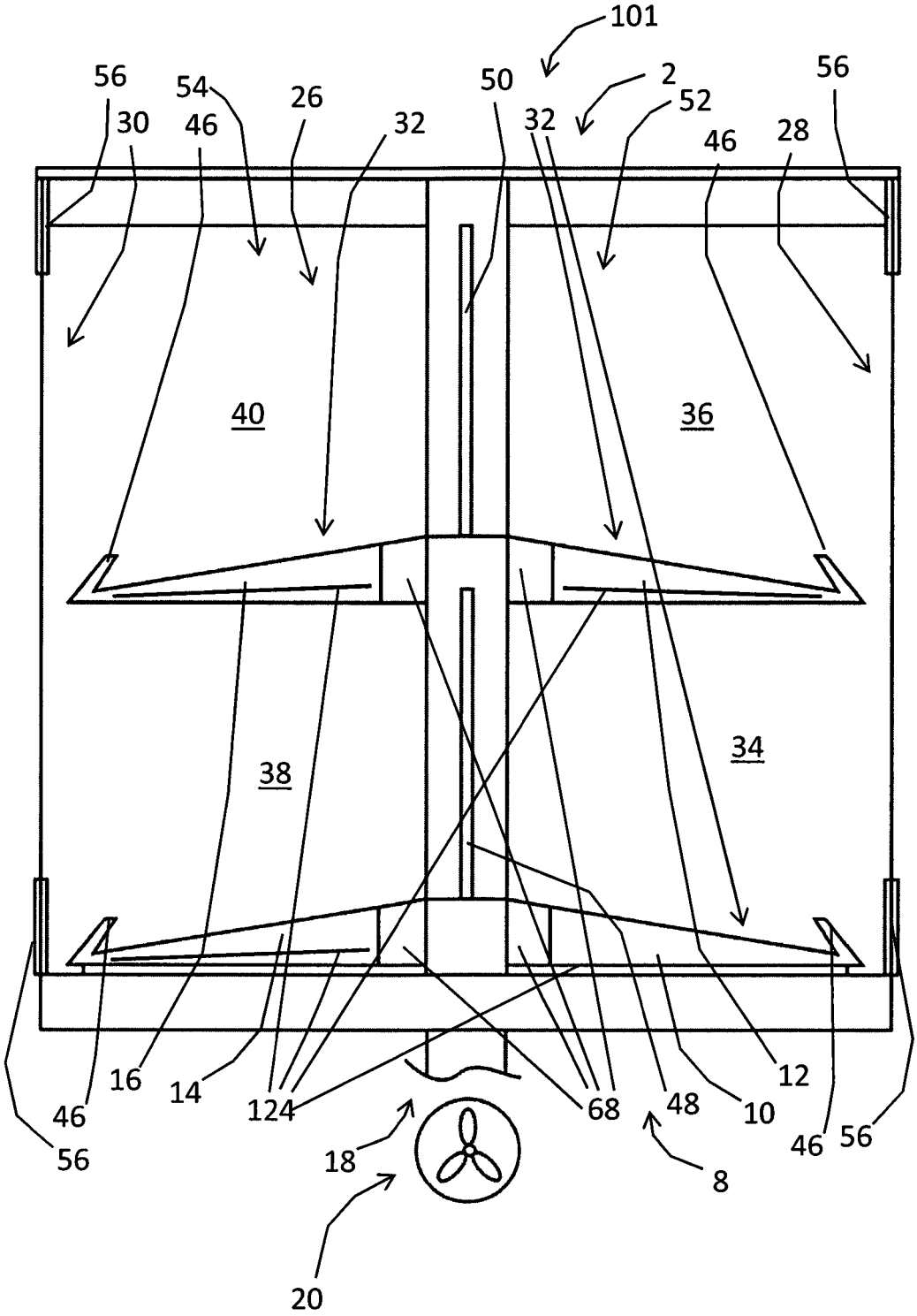
FIG. 8 shows a cross section view through a second embodiment of a display unit according to the invention.

FIG. 8 shows a second embodiment of a display unit 101 according to the invention. The same or similar elements as in the first embodiment are denoted with the same reference numbers, and are not explained in detail.

Each shelf 10, 12, 14, 16 of the display unit 101 further comprises a pressure chamber 68. The pressure chamber 68 has an elongated rectangular shape, is provided in the hollow space of the respective shelf 10, 12, 14, 16, and extends along the width direction of each shelf 10, 12, 14, 16. The pressure chamber 68 is in communication with the first and second vertically extending outlet ducts 60, 62 via the openings 66. Each pressure chamber 68 comprises a row of further openings (not shown in FIG. 8), connecting each pressure chamber 68 with the rest of the hollow space of the respective shelf 10, 12, 14, 16. The pressure chambers 68 provide for a uniform air flow through the hollow space of the respective shelf 10, 12, 14, 16.

The display unit 101 of this embodiment comprises an air heater, comprising multiple flat shaped electrical heating elements 124. Each shelf 10, 12, 14, 16 is provided with one flat shaped electrical heating elements 124.

In practice, a display unit according to the invention, such as one of the display units 1, 101 described above, is used for presenting heated goods to potential buyers. These goods are placed on the placing sides 32 of the multiple shelves 10, 12, 14, 16. The fans 20, 22 draw air from the upper region of the first, respectively second chamber 52, 54 via the inlets 42, 44, as shown with dotted arrows in FIG. 7, and with the dot/hyphen arrows in FIG. 5. The air is transport downwards through the first and second vertically extending inlet ducts 62, 64 to the fans 20, 22, and forced upwards through the first and second vertically extending outlet ducts 58, 60, as shown schematically with dotted arrows in FIG. 5. Note that the placement of the arrows in FIG. 5 appears to suggest that incoming, downwards air flow to the fans 20, 22 and the outgoing air flow are located left and right of each other (in the orientation of FIG. 5), with the transparent walls 48, 50 separating these. However, the actual outlet ducts 58, 60 and inlet ducts 62, 64 are located in front of each other (in the orientation of FIG. 5), as can be seen clearly in the top sectional views of FIGS. 3, 6, and 7. Accordingly, the ingoing and outgoing air flows are in front of each other as well, seen in the orientation of FIG. 5.

The air flow enters the hollow shelves 10, 12, 14, 16 through the openings 66. In the embodiment of FIG. 8, the air flow enters the pressure chamber 68 via the openings 66 first, and then enters the rest of the respective hollow shelf 10, 12, 14, 16. Subsequently, the air flow is heated by the electrical heating elements 24 (see FIGS. 4 and 6), or the flat shaped heating element 124 (FIG. 8). The heated air and the radiation from the electrical heating elements 24, 124, warm the goods in the storage spaces 34, 36, 38, 40 from below through the placing sides 32. The heated air then exits the air duct 18 via the outlets 46 (see FIG. 5). The outlets 46 direct the heated air upwards and backwards into the storage spaces 34, 36, 38, 40. The air flow deflects against the ceiling of the respective storage space 34, 36, 38, 40, either the bottom side of another shelf 12, 16, or the bottom side of the top wall 2, and is directed down by the glass walls 48, 50. At the bottom of the glass walls 48, 50 the air flow continues over the placing side 32 of the respective shelf 10, 12, 14, 16, where it warms the goods on the placing sides 32 from above. The air flow then continues upwards. The upward air flow from the lower storage spaces 34, 48 then at least partly enters the upper storage spaces 36, 40, because it is drawn in by the relative high velocity of the air flow coming out of the outlets 46 of the upper shelves 12, 16. The upward air flow from the upper storage spaces 36, 40 is drawn into the outlets 42, 44.

It is important for the heating of the goods on the placing sides 32, that the air flow as described is relative constant and not too much disturbed by influences from outside. The glass walls 48, 50 ensure that the air flows in adjacent storage spaces 34, 36, 38, 40 do not influence each other. Moreover, the glass walls 48, 50 prevent the occurrence of a draught through the storage spaces 34, 36, 38, 40 from one open front side 28, 30 to another. Because the glass walls 48, 50 are transparent, the lower storage spaces 34, 38 appear to be one space, the upper storage spaces 36, 40 appear to be one space too, and users have an overview over all goods from both open front sides 28, 30.

Several variants are possible within the scope of the attached claims. The features of the above described preferred embodiments may be replaced by any other feature within the scope of the attached claims, such as the features described in the other of the two preferred embodiments, or in the following paragraphs. Accordingly, an embodiment of the invention has a pressure chamber in each shelf and multiple heating elements in the shelves. In another embodiment, the shelves do not have a pressure chamber, and each shelf has one flat shaped electrical heating element.

In an embodiment, the transparent wall, or walls, and/or the rectangular transparent sheets in front of the storages spaces are made of transparent plastic, such as Perspex™.

Two air ducts are advantageous in terms of air flow. However, another embodiment of the invention has one air duct, e.g. an air duct at one side of the transparent wall, or walls. In another embodiment, the air ducts are integrated within the side walls of the display unit.

In an embodiment, further outlets are provided, in particular one outlet at the lower side of each open front side of the display unit that provides an air curtain in front of the shelves and/or multiple small outlets in the upper and/or lower sides of the shelves.

Advantageously, the outlets are formed by a slotted-shaped opening that extends as one opening over substantially the entire width of each shelf, as in the above described embodiment. A comparable effect can be achieved through a series of outlets that extend substantially along a line parallel to the front edge of the shelf. The outlet can also be provided directly in the top side of the shelf in which the required outlet is achieved in an upwards and to the rear direction of the flowing hot air through partitions and/or fins. In the illustrated embodiment shown above, the outlets are provided along the farthest away front edge of the shelf. It is also possible that the outlets extend at a distance from and parallel to the front edge of the shelf, in which part of the shelf extends in front of the outlet. This part that extends in front of the outlet is small relative to the depth of the shelf and is not a part of the shelf that is used to place food on. The part of the shelf that is used to place food on is referred to as the placing part.

Generally, the flow direction of the outlets creates an angle of between 5 and 80 degrees with a plane in which the placing side of the shelf extends. Particularly, this angle amounts to between 15 and 65 degrees and, even more particularly, between 30 and 45 degrees. Preferably there are only outlets on the top side of the shelves as illustrated in the embodiment above. There are no outlets in the rear, top and side walls of the display unit and in the bottom side of the shelves. This can provide different advantages. For example, this can provide a simpler construction, fewer air ducts would suffice and a smaller quantity of air can be circulated.

In an embodiment, further inlets are provided and/or placed at other positions. Inlets may be provided more to the front of the storage spaces, and/or in the upper area of the lower storage spaces, and/or or in a lower area of the storage spaces in order to suck out relative cold air.

In an embodiment, the air forcing apparatus is an air pump. In an alternative, an air flow can be provided and the air circulation can also be realised in a natural manner by using the density differences between hot and cold air. In such an embodiment, the air heater also acts as an air forcing apparatus. Preferably the inlet opening will then be provided at a lower level than the outlets.

In an embodiment, the air heater is a condenser of a heat pump. In particular, the evaporator of the heat pump cools a refrigerator, freezer, or display unit for cooled goods that is located in the vicinity of, or even integrated with, the display unit according to the invention. In another embodiment, the air heater is a burner for gas or liquid fuel. In an embodiment, the air heater is placed elsewhere in the air duct, e.g. in the part of the air duct that is in a lower support structure of the display unit. In an embodiment, the air heater extends around the air duct.

In an embodiment, the multiple shelves are fixed permanently, or semi-permanently, to the side walls and/or air duct. In another embodiment, the multiple shelves are removably attached, which is advantageous for cleaning purposes. The number of shelves may be less than four, e.g. two, or more than four, e.g. six, eight, ten, or even more. An even number is advantageous, as it enables a symmetric placement of shelves in the first and second chamber. The shelves extend substantially horizontally. Substantially horizontally means that the placing side of the shelf extends in such a plane that goods can be placed on this placing side without them falling off. Partitions or other means may have been provided within this context on the placing side of the shelf that contributes towards the goods remaining on the placing side. The placing side of the shelf creates an angle of less than 45 degrees with a horizontal face, which is considered to be substantially horizontal for the present invention. In particular, the placing side of the shelf creates an angle of less than 35 degrees with a horizontal face. The shelves preferably comprise a closed area to impede the exchange of air between two storage spaces that are on top of the other. Due to the air curtains according to the invention, the front side of the display unit can remain open during use. To save on energy, the open front side can also be provided with a door to close the open front side temporarily or semi permanently.

The invention claimed is:

1. A display unit for storing and displaying heated goods, comprising:

multiple walls wherein at least part of the walls delimit a main chamber, and wherein the main chamber comprises a first open front side and a second open front side opposite of the first open front side;

multiple shelves each comprising an upper placing side, wherein each one of the multiple shelves extends in the main chamber and defines an individual corresponding storage space above its upper placing side;

an air duct extending from at least a first inlet to multiple outlets which are in communication with the storage spaces;

an air forcing apparatus; and an air heater; and a transparent wall which is positioned in the main chamber between the first open front side and the second open front side, and dividing the main chamber into a first chamber and a second chamber.

2. The display unit according to claim 1, wherein the transparent wall is made of glass.

3. The display unit according to claim 1 wherein the transparent wall is positioned halfway in the middle of the main chamber.

4. The display unit according to claim 1, wherein the air duct comprises a first vertically extending outlet duct positioned at a side edge of the transparent wall for guiding air towards the outlets.

5. The display unit according to claim 4, wherein the air duct comprises a second vertically extending outlet duct positioned at a side edge of the transparent wall opposite of the first vertically extending outlet duct for guiding air towards the outlets.

6. The display unit according to claim 1, wherein the air duct comprises a first vertically extending inlet duct positioned at a side edge of the transparent wall for guiding air from the first inlet.

7. The display unit according to claim 6, wherein the air duct further comprises a second vertically extending inlet duct positioned at a side edge of the transparent wall opposite of the first vertically extending inlet duct for guiding air from a second inlet.

8. The display unit according to claim 1, wherein the first inlet is in an upper region of the main chamber.

9. The display unit according to claim 8, further comprising a second inlet provided in an upper region of the main chamber.

10. The display unit according to claim 1, wherein at least one of the outlets is positioned at a front edge of at least one of the multiple shelves.

11. The display unit according to claim 10, wherein each of the shelves has at least one of the outlets positioned at the front edge.

12. The display unit according to claim 11, wherein the at least one outlet is directed upwards and towards the transparent wall for directing an airflow into the corresponding storage space.

13. The display unit according to claim 10, wherein the at least one outlet is directed upwards and towards the transparent wall for directing an airflow into the corresponding storage space.

14. The display unit according to claim 1, wherein all outlets discharge into the storage spaces.

15. The display unit according to claim 1, wherein at least one of the shelves is hollow and defines part of the air duct.

16. The display unit according to claim 1, wherein the upper placing side of at least one of the shelves is airtight.

17. The display unit according to claim 1, wherein the air heater comprises at least one heating element that is provided in one of the multiple shelves.

18. The display unit according to claim 17, wherein the heating element is flat-shaped.

19. The display unit according to claim 17, wherein the air heater comprises multiple heating elements, and each of the multiple shelves is provided with one heating element.

20. The display unit according to claim 1, wherein the air heater comprises multiple heating elements, and all shelves are provided with multiple heating elements.

* * * * *